US010677028B2

(12) United States Patent
Oliphant

(10) Patent No.: US 10,677,028 B2
(45) Date of Patent: Jun. 9, 2020

(54) DOWNHOLE ARTIFICIAL LIFT SYSTEM

(71) Applicant: Weatherford U.K. Limited, Leicestershire (GB)

(72) Inventor: Martin Oliphant, Leicestershire (GB)

(73) Assignee: Weatherford U.K. Limited, Leicestershire (GB)

( * ) Notice: Subject to any disclaimer, the term of this patent is extended or adjusted under 35 U.S.C. 154(b) by 127 days.

(21) Appl. No.: 15/765,590

(22) PCT Filed: Oct. 5, 2016

(86) PCT No.: PCT/GB2016/053093

§ 371 (c)(1),
(2) Date: Apr. 3, 2018

(87) PCT Pub. No.: WO2017/060696

PCT Pub. Date: Apr. 13, 2017

(65) Prior Publication Data

US 2019/0078421 A1 Mar. 14, 2019

(30) Foreign Application Priority Data

Oct. 6, 2015 (GB) ..... 1517633.2

(51) Int. Cl.
*E21B 43/12* (2006.01)

(52) U.S. Cl.
CPC ..... *E21B 43/122* (2013.01); *E21B 43/128* (2013.01)

(58) Field of Classification Search
CPC ..... E21B 43/122; E21B 43/128
See application file for complete search history.

(56) References Cited

U.S. PATENT DOCUMENTS

| | | | | |
|---|---|---|---|---|
| 4,405,291 | A | 9/1983 | Canalizo | |
| 6,138,758 | A | 10/2000 | Shaw et al. | |
| 7,363,983 | B2 | 4/2008 | Martinez et al. | |
| 2005/0230121 | A1 | 10/2005 | Martinez et al. | |
| 2007/0044960 | A1* | 3/2007 | Lovell | E21B 17/206 166/250.07 |
| 2012/0012333 | A1 | 1/2012 | Quigley et al. | |
| 2015/0114632 | A1* | 4/2015 | Romer | E21B 4/003 166/250.15 |

(Continued)

FOREIGN PATENT DOCUMENTS

| | | | |
|---|---|---|---|
| GB | 2443327 | A | 4/2008 |
| WO | 98/13579 | A2 | 4/1998 |
| WO | 99/15755 | A2 | 4/1999 |

OTHER PUBLICATIONS

Prakoso, N F, et al., "Single String Packerless ESP Gas Lift Hybrid: Optimizing Production and Minimizing Loss," SPE 128974, Jan. 22, 2010, pp. 1-8.

(Continued)

*Primary Examiner* — Brad Harcourt
(74) *Attorney, Agent, or Firm* — Blank Rome LLP

(57) ABSTRACT

A downhole artificial lift system comprises a production string for communicating fluid from a downhole location towards surface, a pump arrangement in communication with the production string for pumping fluid along the production string towards surface, and a gas lift arrangement deployed within the production string for delivering a lift gas into the production string.

17 Claims, 3 Drawing Sheets

(56) References Cited

U.S. PATENT DOCUMENTS

| | | | | |
|---|---|---|---|---|
| 2015/0233228 | A1 | 8/2015 | Roth et al. | |
| 2015/0247390 | A1* | 9/2015 | Mazzanti ..... | E21B 17/18<br>166/372 |

OTHER PUBLICATIONS

Aitken, K J, et al., "Combined ESP/Auto Gas Lift Completions in High GOR/High Sand Wells on Australian Northwest Shelf," SPE 64466, Oct. 18, 2000, pp. 1-6.
Int'l Search Report and Written Opinion in counterpart PCT Appl. PCT/GB2016/053093, dated Dec. 15, 2016, 13-pgs.
Search Report in counterpart UK Appl. GB 1517633.2, dated Mar. 22, 2016, 4-pgs.

* cited by examiner

DOWNHOLE ARTIFICIAL LIFT SYSTEM

FIELD

The present disclosure relates to a downhole artificial lift system, apparatus and method of using the same in wellbore operations.

BACKGROUND

In oil and gas operations in order to enhance the rate at which fluid is produced, or when the reservoir pressure is insufficient to lift the produced fluids, an artificial lift system employing an electric submersible pump (ESP) may be used.

A typical ESP system may be designed for optimum operation within a certain operating window corresponding to the conditions of a particular well. Hence, after installation of the ESP system within a well, if well conditions change significantly then the installed ESP may no longer be operable at optimal conditions and may have to be replaced. Replacing an ESP may be time-consuming and may require shutting down production. Hence, replacing an ESP may generally be expensive to implement.

Also, ESP systems may generally require large amounts of electrical power and high voltages for their operation. This may also result in larger size, more difficult to deploy power cables for providing power from a surface power source to the motor of an ESP system.

SUMMARY

An aspect or embodiment relates to a downhole artificial lift system, comprising: a production string for communicating a fluid from a downhole location towards surface; a pump arrangement in communication with the production string for pumping the fluid along the production string towards surface; and a gas lift arrangement deployed within the production string for delivering a lift gas into the production string.

The production string may be deployed within a wellbore such as cased or openhole wellbore of an oil or gas well. However, the downhole artificial lift system may also be used in downhole applications other than oil and gas industry applications. For example, the downhole artificial lift system may be used in water wells.

In operation, the downhole artificial lift system may be employed for lifting fluid from a downhole location when downhole or reservoir fluid pressure is insufficient for lifting the fluid to the surface, and/or for enhancing the rate at which fluid is produced to the surface. Accordingly, in operation, the pump arrangement may function to drive the fluid towards the surface. In addition, the gas lift arrangement may inject gas to the fluid to reduce its density and may also create a scrubbing action on the fluid, both actions resulting in a reduction of the fluid pressure at the discharge point of the pump arrangement. As a result the overall fluid flow rate at which the fluid may be produced to the surface may be enhanced and/or the total head requirement for the pump arrangement may be reduced.

The pump and gas lift arrangements may be positioned in a series configuration i.e. one after another, within the same production string. Positioning the pump and gas lift arrangements together in a series configuration within a single production string may result in a substantial reduction in the energy, voltage, power cable size, and/or other design requirements for the pump arrangement and/or for the overall system.

The downhole artificial lift system may allow ready optimization of its operating parameters to accommodate changing wellbore conditions such as fluid viscosity, reservoir pressure, reservoir temperature, fluid flow rate and/or the like.

The downhole artificial lift system may provide a simple and economical way for extending the operating window of a downhole pump based artificial lift system such as an ESP system, especially in operations where gas may be readily available.

The downhole artificial lift system may reduce the size requirement for a power cable providing power from a surface power source to the downhole artificial lift system. This may facilitate improved deployment of the power cable in the wellbore annulus often through one or more packers or other obstructions and may reduce the risk of compromising the integrity of the isolation of the wellbore annulus.

The downhole artificial lift system may be pre-installed as part of a wellbore completion.

The downhole artificial lift system may be installed as a retrofit solution to existing completions.

The downhole artificial lift system may be partially pre-installed as part of a new completion with only some of the components of the downhole artificial lift system being pre-installed while any remaining components may be installed later when needed. For example, according to one embodiment, a pump arrangement may be pre-installed within a production string of a new completion, while a gas lift arrangement may be installed later once additional lifting may be needed for the wellbore fluid, for example because of reduced reservoir fluid pressure.

The downhole artificial lift system may be used with a cased wellbore.

The downhole artificial lift system may be used with an openhole wellbore.

The downhole artificial lift system may be used with any type of wellbore including a vertical, deviated or horizontal wellbore and/or combinations thereof.

The downhole artificial lift system may be used with oil and gas operations. The downhole artificial lift system may be used in onshore wellbores. The downhole artificial lift system may be used in offshore wellbores.

Dependent upon the application, the positioning of the gas lift arrangement relative to the position of the pump arrangement may differ.

The gas lift arrangement may be positioned at a location above the pump arrangement i.e. at a location closer to the surface or entry point of the associated well than the pump arrangement. Such configuration may be particularly advantageous in reducing the weight of the fluid column that the pump arrangement has to displace. Also, such configuration may be advantageous in retrofitting an existing artificial lift system, such as for example a pre-installed pump system, to improve its operation without having to remove a pre-installed pump arrangement.

The gas lift arrangement may be positioned at a location below the pump arrangement, i.e. at a location further away from the surface or entry point of the associated well than the pump arrangement. Such configuration may be advantageous, for example, by reducing the density and/or viscosity of the produced fluids prior to entering the pump arrangement. Also, in some completions comprising one or more pre-installed gas lift arrangements, such as one or more side pocket mandrels mounted on the production string, it may be advantageous to position a pump arrangement above the location of at least one of the pre-installed gas lift arrangements.

The pump arrangement may be any suitable pump arrangement. The pump arrangement may comprise an electrical submersible pump (ESP). The pump arrangement may comprise a pump unit, a motor unit, such as an electrical motor unit that operates the pump unit, and a protector to prevent fluids from entering the motor.

The downhole artificial lift system may comprise a cable operatively linking the pump arrangement to a power source for providing power to the pump arrangement. The cable may be an electrical cable for transferring electrical power from a surface power source to the pump arrangement. The cable may be deployed through a wellbore annulus formed between the production string and the wellbore casing or wall if the wellbore is not cased. The cable may be sealingly fed through any packers or other obstacles found in the wellbore annulus using well known methods.

Any suitable motor unit, such as a three-phase induction motor may be used.

The pump unit may be any suitable pump unit used in downhole pump arrangements such as ESP systems. For example, the pump unit may comprise a centrifugal pump having one or more pump stages.

The gas lift arrangement may be any suitable gas lift arrangement.

The gas lift arrangement may be adapted to be deployed within the production string. The gas lift arrangement may be pre-installed within the production string.

The gas lift arrangement may be or comprise a housing. The housing may be adapted to be deployable within the production string. The housing may comprise one or more ports fluidly connecting the gas arrangement with the production string.

The gas lift arrangement may comprise one or more gas lift valves for controlling gas flow between the gas arrangement and the production string. The one or more gas lift valves may be comprised within the housing of the gas lift arrangement for controlling gas flow through the one or more ports of the housing.

The one or more gas lift valves may define one way valves.

The gas lift arrangement may comprise one or more valves for controlling fluid flow such as produced fluid flow between the gas arrangement and the production string.

The one or more gas lift valves and the one or more fluid flow valves may be the same or different valves.

The gas lift arrangement may comprise a side entry gas lift arrangement, i.e. comprising one or more ports, for example a side entry port, for fluidly connecting external and internal regions of the production string. In one embodiment, such a side entry gas lift arrangement may fluidly connect a wellbore annulus or a gas conduit deployed through a wellbore annulus with the interior of the production string.

According to an embodiment, gas from a source, for example a source located at surface, may be delivered into a wellbore annulus to enter the production string via the one or more ports, for example side-entry ports, of the gas lift arrangement. However, it should be understood that the gas source may be located downhole. For instance, the gas source may be a gas reservoir.

The gas lift arrangement may comprise one or more side pocket mandrels installed in the production string. The one or more side pocket mandrels may have one or more ports, e.g. side-entry ports, for fluidly connecting external and internal regions of the production string, for example the wellbore annulus with the interior of the production string. The one or more side pocket mandrels may have one or more gas lift valves for controlling gas flow via the one or more ports.

One or more side pocket mandrels may be installed above and/or below the location of the pump arrangement as may be required based on the wellbore operating conditions.

A gas conduit may be deployed through the wellbore annulus to fluidly connect the gas lift arrangement with a gas source, for example a surface gas source. Accordingly, gas from the source may be delivered into the gas conduit to enter the production string via one or more ports, for example side-entry ports, or ports of a housing of a gas lift arrangement deployed within the production string.

The gas lift arrangement may be mounted to a gas lift tubing string, such as a coiled tubing string, adapted to be deployable or deployed within the production string. Such a system may also generally be referred to hereinafter as an Inverted Gas lift System (IGLS). An IGLS may allow injection of gas directly into the production string without necessarily delivering gas into the wellbore annulus.

The IGLS may allow gas from a source, for example a source located at surface to be delivered through the gas lift tubing string of the IGLS (also referred to hereinafter as the IGLS tubing) into the gas lift arrangement and through one or more ports of the gas lift arrangement into the production string. The delivered gas may return to the surface mixed with produced fluid, via a tubing annulus formed between the IGLS tubing and the production string.

Alternatively, the IGLS may allow gas from a source, for example a source located at surface to be delivered through an annulus formed between the IGLS tubing and the wall of the production string (also referred to hereinafter as the IGLS tubing annulus) and then, through one or more ports of the gas lift arrangement, the delivered gas may enter into the interior of the IGLS tubing and lift the production fluid or fluids through the IGLS tubing. According to this embodiment, one or more packers may be used to isolate the IGLS tubing annulus from a point below the one or more gas lift ports. The one or more packers may be of any suitable type including mechanical set packers, hydraulic set packers, inflatable packers, swellable packers and the like.

With an IGLS, the delivered gas may be contained within the production string and may never enter the wellbore annulus. This may be advantageous for a number of reasons. For example, often concerns for the integrity of a wellbore annulus may render the use of high pressure gas in the annulus problematic. Also, gas injection through the wellbore annulus may not be possible without removing one or more pre-installed packers.

Further, in embodiments where a power cable of the pump arrangement is deployed through the wellbore annulus, delivering pressurized gas into the wellbore annulus in the presence of the power cable may raise safety concerns. Such concerns may be particularly pronounced at high gas pressure gas lift applications that may render conventional power cable protection methods problematic. Hence, employing an IGSL may be particularly advantageous in applications where the use of a pump arrangement in conjunction with a side entry gas lift may be problematic for safety reasons or other reasons that may require special design for the power cable.

Employing an IGLS may be particularly advantageous in retrofitting an existing pump arrangement, such as an ESP arrangement, due to changing wellbore conditions. For example, in the event that the reservoir pressure and/or the fluid consistency and/or properties such as fluid density, viscosity and the like of the wellbore fluid change overtime so that they fall outside an optimum operating window for an initially installed pump arrangement, the pump arrangement may be retrofitted by adding an IGLS above the pump arrangement.

The IGLS tubing may be or comprise a single continuous tubular member, or may comprise a plurality of tubular members joined together with a permanent connection such as welding or via non-permanent connectors. The IGLS tubing may be coiled tubing. Any type of coiled tubing may be used.

According to one embodiment, the IGLS may be a coiled tubing IGLS, i.e. one that employs a gas lift arrangement mounted to a coiled tubing. The coiled tubing may be used to deploy the gas lift arrangement to the desired depth within the production string.

The IGLS may comprise one or more gas lift arrangements. The one or more gas lift arrangements may be of any suitable type, size geometry.

The one or more gas lift arrangements may comprise a housing adapted to be mounted to the IGLS tubing. For example, the housing of the one or more gas lift arrangements may be connected to the IGLS tubing, such as coiled tubing, via any suitable connector or method such as via a threaded connection. The use of non-permanent connectors may be advantageous for adding modularity and adaptability to the overall system.

The housing of the one or more gas lift arrangements may have the same outside diameter as the IGLS tubing. This may facilitate feeding the IGLS through conventional well head equipment, such as an injector. It may also facilitate spooling of the IGLS on conventional reels or spools, such as the ones used for example with coiled tubing.

The housing of the one or more gas lift arrangements may define an internal fluid passage. The internal fluid passage may have the same internal diameter as the IGLS tubing. This may be particularly advantageous if the delivered gas together with the produced fluid is to be returned to the surface via the interior of the IGLS tubing to avoid creating areas where particles and or other sticky substances typically found in wellbore fluids may accumulate overtime and create undesirable obstructions.

The one or more gas lift arrangements may be made of or comprise any suitable material including but not limited to metals and non-metallic materials. Suitable non-metallic materials may include engineering polymers, such as for example a polyether ether ketone (PEEK). Employing a gas lift arrangement comprising a non-metallic material may facilitate spooling the IGLS tubing together with the gas lift arrangement around a conventional reel or spool.

The downhole artificial lift system may comprise other components. For example, the downhole artificial lift system may comprise a safety valve. An IGLS may comprise a safety valve. The safety valve may be a dual flow safety valve.

According to an embodiment, the artificial lift system may comprise an IGLS having a dual safety valve. The dual safety valve may comprise two flow paths, a central bore flow path fluidly connected at both ends thereof to the interior of the gas lift tubing string and one or more annular bores fluidly connected to the fluid flow in the annulus formed between the gas lift tubing string and the production string. The central bore may be used to inject gas into the production string. The annular bores may be used for the produced fluids to flow to the surface. One or more seals may be used to seal the area between the outside wall of the dual flow safety valve and the production string. Any type of suitable seals may be used. A valve element may be used to control the gas and or fluid flow though the central bore. The valve element may be any suitable element such as a flapper valve element.

Another aspect or embodiment relates to a method for lifting a fluid from a downhole location, such as a produced fluid of a wellbore, towards or to the surface, the method comprising deploying a downhole artificial lift system having any of the features of the aforementioned downhole artificial lift system within a production string the production string being deployed within a wellbore.

An aspect or embodiment relates to a method for lifting a fluid from a downhole location towards the surface, the method comprising: deploying a pump arrangement within a production string deployed within a wellbore for pumping the fluid along the production spring towards the surface; and deploying a gas lift arrangement within a production string for delivering a lift gas into the production string.

The method may comprise delivering a lift gas into the production string to facilitate lifting the fluid to the surface.

The method may comprise modifying the rate of the lift gas delivered into the production string to reduce power and/or voltage requirements for the pump arrangement, and/or maintain the operation of the pump arrangement within an optimal operating window.

The method may comprise modifying the rate of the lift gas delivered into the production string to maintain or enhance the rate at which the fluid is lifted towards the surface.

The gas lift arrangement used in the method may have any of the features described above. For example, the gas lift arrangement may be mounted to a gas lift tubing string deployed within the production string. The gas lift arrangement may be positioned at a location above or below the pump arrangement.

The pump arrangement used in the method may also have any of the features described above. For example the pump arrangement may comprise an electrical submersible pump.

The method may further comprise deploying a cable for operatively linking the pump arrangement to a power source for providing power to the pump arrangement.

The gas lift arrangement used in the method may be adapted to deliver gas from a source directly into the production string without delivering gas into a wellbore annulus.

The gas lift arrangement used in the method may be adapted to deliver gas from a source through the gas lift tubing string into the production string.

The method may comprise delivering gas from a source through a tubing annulus formed between the gas lift tubing string and the production string and then through one or more ports of the gas lift arrangement into the interior of the gas lift tubing to lift the fluid through the gas lift tubing.

The method may further comprising deploying one or more packers for isolating the annulus formed between the gas lift tubing string and the production string from a point below the one or more gas lift ports for allowing delivering gas through the gas lift tubing annulus into the gas lift arrangement and then into the gas lift tubing.

Another aspect or embodiment relates to a method for lifting a fluid from a downhole location towards the surface, the method comprising: pumping the fluid towards the surface within a production string deployed within a wellbore using a pump arrangement; delivering a lift gas into a production string deployed within a wellbore via a gas lift arrangement deployed within the same production string without delivering any lift gas through a wellbore annulus; and lifting the fluid mixed with the delivered lift gas towards the surface.

The gas lift arrangement used in the method may have any of the features described above, for example, the gas lift arrangement may be mounted to a gas lift tubing deployed within the production tubing.

The method may comprise delivering the lift gas from a source through the gas lift tubing and through the gas lift arrangement into the production tubing.

The method may comprise lifting the fluid mixed with the delivered lift gas through an annulus formed between the gas lift tubing string and the production tubing.

The method may comprise delivering the lift gas into the production string via an annulus formed between the gas lift tubing and the production tubing.

The method may comprise lifting the fluid mixed with the delivered lift gas towards the surface via the interior of the gas lift tubing.

The method may comprise modifying the rate of the lift gas delivered into the production string to reduce power and/or voltage requirements for the pump arrangement, and/or maintain the operation of the pump arrangement within an optimal operating window.

The method may comprise modifying the rate of the lift gas delivered into the production string to maintain or enhance the rate at which the fluid is lifted towards the surface.

An aspect or embodiment relates to a method for improving the performance of a downhole pump system installed to a production string of a wellbore, the pump system having one or more pump arrangements, the method comprising: deploying into the production string a gas lift system comprising at least one gas lift arrangement; positioning the at least one gas lift arrangement above or below at least one of the one or more pump arrangements; delivering gas through the gas lift arrangement into the production string; and returning the delivered gas mixed together with produced fluids through the production string to surface.

The positioning of the least one gas lift system may comprise positioning at least one gas lift arrangement above an uppermost pump arrangement.

The gas lift system may be an IGLS system comprising at least one gas lift arrangement mounted to an IGLS tubing.

The gas lift arrangement may be a side-entry gas lift.

The at least one gas lift arrangement may be positioned above an uppermost pump arrangement.

Delivering gas may comprise delivering pressurized gas through an annulus formed between an IGLS tubing and the production string through the IGLS into the production string.

Delivering gas may comprise delivering pressurized gas through an IGLS tubing and the gas lift arrangement into the production string.

Returning the delivered gas mixed together with produced fluids to surface may comprise flowing the mixture through an annulus formed between an IGLS tubing and the production string.

Returning the delivered gas mixed together with produced fluids to surface may comprise flowing the mixture through the interior of an IGLS tubing.

An aspect or embodiment relates to a downhole artificial lift apparatus comprising: a pump arrangement mounted on a pipe for pumping a fluid along the pipe; and a gas lift arrangement for delivering a lift gas into the pipe.

The pump and the gas lift arrangements may be mounted within the same pipe or alternatively may be mounted within different pipes which may be joined to form a production string.

Other embodiments and/or advantages of the present invention downhole artificial lift system will become apparent to a person skilled in this art from the detailed description of the invention in association with the following drawings.

For example, according to an embodiment, the pump and gas lift arrangements may be mounted to a first and second pipes respectively, wherein the first and/or second pipes may be adapted to form part of, and/or be deployed within one or more tubulars forming a single production string.

Also, it should be understood that features described in relation to one aspect and/or embodiment of the invention may be used with any other aspect or embodiment of the invention.

BRIEF DESCRIPTION OF THE DRAWINGS

These and other aspects or examples will now be described, by way of example only, with reference to the accompanying drawings, in which.

DETAILED DESCRIPTION OF DRAWINGS

Figure 1:
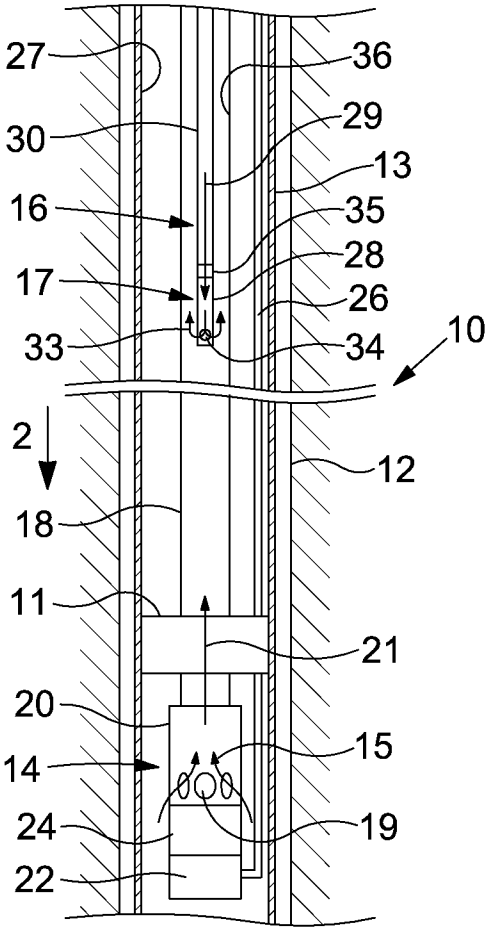
FIG. 1 is a simplified, diagrammatic representation of a production string deployed within a vertical wellbore comprising a downhole artificial lift arrangement.

Referring to FIG. 1, there is shown a downhole artificial lift system generally designated with numeral 10. In FIG. 1, the downhole direction is indicated by arrow 2.

It should be understood that references to a particular direction or orientation such as down, up, upper, lower, above, below, side, and the like used throughout the following description apply to the orientation of the downhole artificial lift system in use downhole as shown in FIGS. 1 to 4 and are not intended to be limiting in any way.

For example, although the downhole artificial lift system 10 is shown deployed within a vertical wellbore 12, it should be understood that the downhole artificial lift system 10 may be used in any type wellbore including vertical, deviated and horizontal wellbores.

The downhole artificial lift system 10 comprises a pump arrangement generally designated with numeral 14. The pump arrangement 14 is mounted to a production string 18 deployed within casing 13 that lines wellbore 12. The pump arrangement 14 may be mounted to the production string 18 using any suitable connector.

The pump arrangement 14 is operatively connected to a surface power source (not shown) with a power cable 26. The power cable 26 is deployed through wellbore annulus 27 formed between the production string 18 and the casing 13 and is sealingly fed through a production packer 11.

The pump arrangement 14 comprises a pump unit 20, an electrical motor unit 22 that drives the pump unit 20, and a protector 24 to prevent fluids from entering the motor unit 22. The electrical motor unit 22 may be any suitable motor unit, such as for example, a three phase induction motor unit. The pump unit 20 may be any suitable downhole pump such as a multi-stage centrifugal pump. In operation, fluid indicated by arrows 15 enters the pump unit 20 via one or more suction ports 19 and is pumped towards the surface through the production tubing as indicated by arrow 21.

The downhole artificial lift system 10 further comprises a gas lift system which in this example is an inverted gas lift system (IGLS) generally designated with numeral 16. The IGLS 16 comprises a gas lift arrangement generally designated with numeral 17. The gas lift arrangement 17 is positioned within the same production string 18 at a location above the pump arrangement 14, i.e. closer to the surface or an entry point of the wellbore than the pump arrangement 14. The gas lift arrangement 17 comprises a housing 28 mounted to coiled tubing 30 via a suitable coiled tubing connector 35. The coiled tubing 30 may also be referred to as a gas lift tubing string. However, any other suitable means and/or connectors may be used to make the connection between the housing 28 of the gas lift arrangement 17 and the coiled tubing 30 such as for example a welded connection.

The housing 28 is mounted at an end of the coiled tubing 30. Such configuration may allow the outside diameter of the housing 28 to vary while at the same time allowing ready connection with a coiled tubing 30 via a suitably sized connector 35.

However, any other suitable mounting configuration may be used. For example, the housing 28 may be sized so that it may be inserted within an end section of the coiled tubing; or the housing 28 may be mounted outside the coiled tubing 30.

The housing 28 defines a central internal passage in fluid communication with the interior of the coiled tubing 30. The housing 28 further comprises a laterally extending port 34 fluidly connecting the central internal passage of the housing 28 with an annulus 36 formed between the production string 18 and the coiled tubing 30. This annulus 36 may also be referred to as the coiled tubing annulus. A gas lift valve (not shown) for example an injection valve, is disposed within the housing 28 for controlling fluid flow between the interior of the coiled tubing 30 and the annulus 36. The valve may be any suitable valve and may comprise a valve element typically in a closed configuration to block fluid communication between the central internal passage of the housing 28 and the annulus 36. For example, the valve element may be urged against a mating valve seat, using any suitable means, such as springs, to block fluid communication between the central internal passage of the housing 28 and the coiled tubing annulus 36.

When the gas lift valve is activated, the valve element may be dislodged from its seat to allow fluid delivered from the surface through the coiled tubing 30 to pass through the internal passage of the housing 28, and exit through the port 34 into the coiled tubing annulus 36. Hence, in operation, gas is delivered from the surface through the coiled tubing 30 and enters a central passage of the housing 28 as indicated by arrow 29, then through the lateral port 34 exits into the annulus 36 as indicated by arrows 33.

Activation of the gas lift valve may be achieved via any suitable method or mechanism. For example, a gas injection valve may be activated by delivering gas into the coiled tubing at a sufficiently high pressure to dislodge the valve element from the valve seat.

According to one embodiment, the gas lift valve may employ gas charge bellows for urging the valve element in a closed position blocking flow through the central passageway of the gas lift valve, when the gas lift valve is not in use. To activate the gas lift valve, gas may be delivered through the coiled tubing 30 into one or more activation passageways positioned within the housing of the of the gas lift valve. Fluid flow through one or more passageways may be controlled by one or more check valves so that when the one or more check valves open delivered fluid through one or more activation passageways counteracts against the gas bellows to move the valve element to an open position.

Once the gas lift valve is activated, gas flowing through the coiled tubing 16 is delivered into the coiled tubing annulus 36 and may assist lifting the production fluid through the wellbore annulus to the surface.

The outside diameter of the housing 28 of the gas lift arrangement 17 is substantially the same as the outside diameter of the coiled tubing 30. Such configuration may facilitate deployment of the ILLS within the production string. It may also, facilitate spooling the gas lift arrangement 17 together with the coiled tubing 30 using a conventional coiled tubing spool. It should be understood, however, that the outside diameter of the gas lift arrangement may vary and may be the same, larger, or smaller than the outside diameter of the coiled tubing.

It has been observed that positioning the gas lift arrangement and the pump arrangement within the same production string 18 as shown in FIG. 1 results in substantial reduction of the energy and/or voltage requirements for the pump arrangement.

Furthermore, delivering the lift gas directly into the production string 18 via the coiled tubing 30 and gas lift arrangement 17 avoids the requirement to use the wellbore annulus 27 to deliver high pressure gas. In this way the cable 26 for the pump arrangement 14 may be protected from disadvantages associated with being immersed or exposed to high pressure gas.

It should be understood that the relative positioning of the gas lift arrangement 17 and the pump arrangement 14 may vary depending on the system requirements. Ready optimization of the position of the gas lift arrangement 14 may be obtained by moving the gas lift arrangement while the system 10 is operating closer or further away from the entry point of the associated well.

Figure 2:
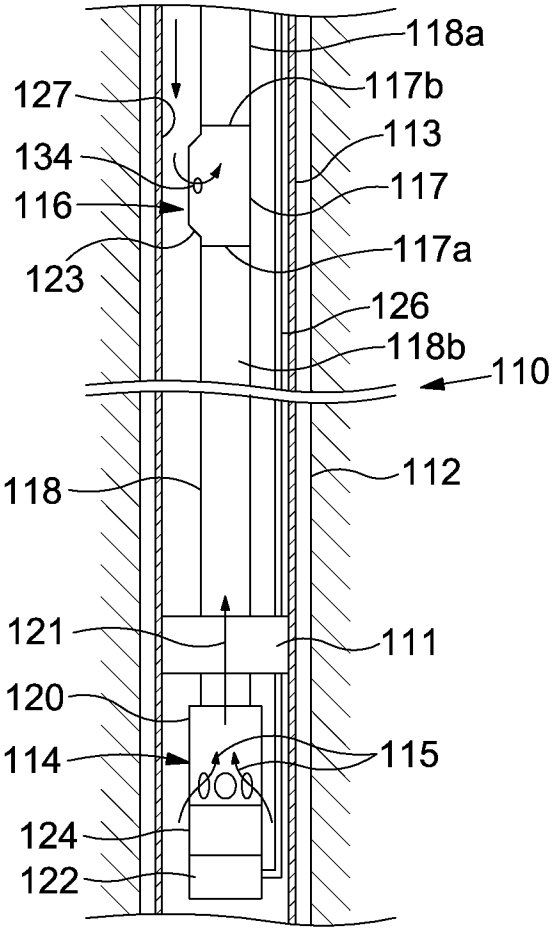
FIG. 2 is a simplified, diagrammatic representation of a production string deployed within a vertical wellbore comprising an alternative downhole artificial lift arrangement.

Referring now to FIG. 2 a downhole artificial lift arrangement 110 will be described which has many features in common with the FIG. 1 and for simplicity similar or identical features are described with the same numerals augmented by 100.

The downhole artificial lift system 110 comprises a pump arrangement generally designated with numeral 114 operatively connected to a surface power source (not shown) with a power cable 126. The power cable 126 is deployed through wellbore annulus 127 formed between production string 118 and casing 113 and is fed through packer 11. The pump arrangement 114 is mounted to production string 118 using a suitable connection.

The pump arrangement 114 comprises a pump unit 120, an electrical motor unit 122, and a protector 124. The electrical motor unit 122 may comprise any suitable motor, such as a three phase induction motor. Pump unit 120 may comprise any suitable downhole pump such as a multi-stage centrifugal pump. In operation, fluid indicated by arrows 115 enters the pump unit 120 via one or more suction ports 119 and is pumped towards the surface through the production tubing 118 as indicated by arrow 121.

The downhole artificial lift system 110 further comprises a side entry gas lift arrangement generally designated with numeral 116 comprising a side pocket mandrel 117. The side pocket mandrel 117 is positioned within the same production string 118 at a location above the pump arrangement 114, i.e. closer to the surface or an entry point of the wellbore than the pump arrangement 114. The side pocket mandrel 117 may be mounted to the production string 118 via any suitable connector. For example, the side pocket mandrel 117 may have threaded connections at both of its ends 117*a* and 117*b* that may connect to mating threaded connections of the tubulars 118*a* and 118*b* forming the production string so that a central throughbore defined within the mandrel 117 may be aligned with the interior bore of the production string 118. The central throughbore of the mandrel 117 may be of the same internal diameter as the interior bore of the production string 118.

The side pocket mandrel 117 further defines a side pocket 123 having a side port 134 fluidly connecting the wellbore annulus 127 with the central throughbore of the side pocket mandrel 117. A gas lift valve (not shown) may be inserted within the side pocket 123 to control fluid flow through side port 134. Any suitable gas lift valve may be employed. The gas lift valve may normally be in a closed position blocking fluid communication between the central throughbore of the mandrel 117 and the wellbore annulus 127.

In operation, gas from the surface may be delivered when needed through the wellbore annulus 127 and enter the production string through the side port 134 of the side pocket mandrel 117. The gas lift valve may be activated to switch to an open position via any suitable method and/or mechanism. For example, the gas lift valve may comprise a valve element normally in the closed position via a spring or other biasing mechanism. Once gas is delivered through the wellbore annulus the valve element may be dislodged from the valve seat to allow gas delivered from the surface to enter the production string.

Figure 3:
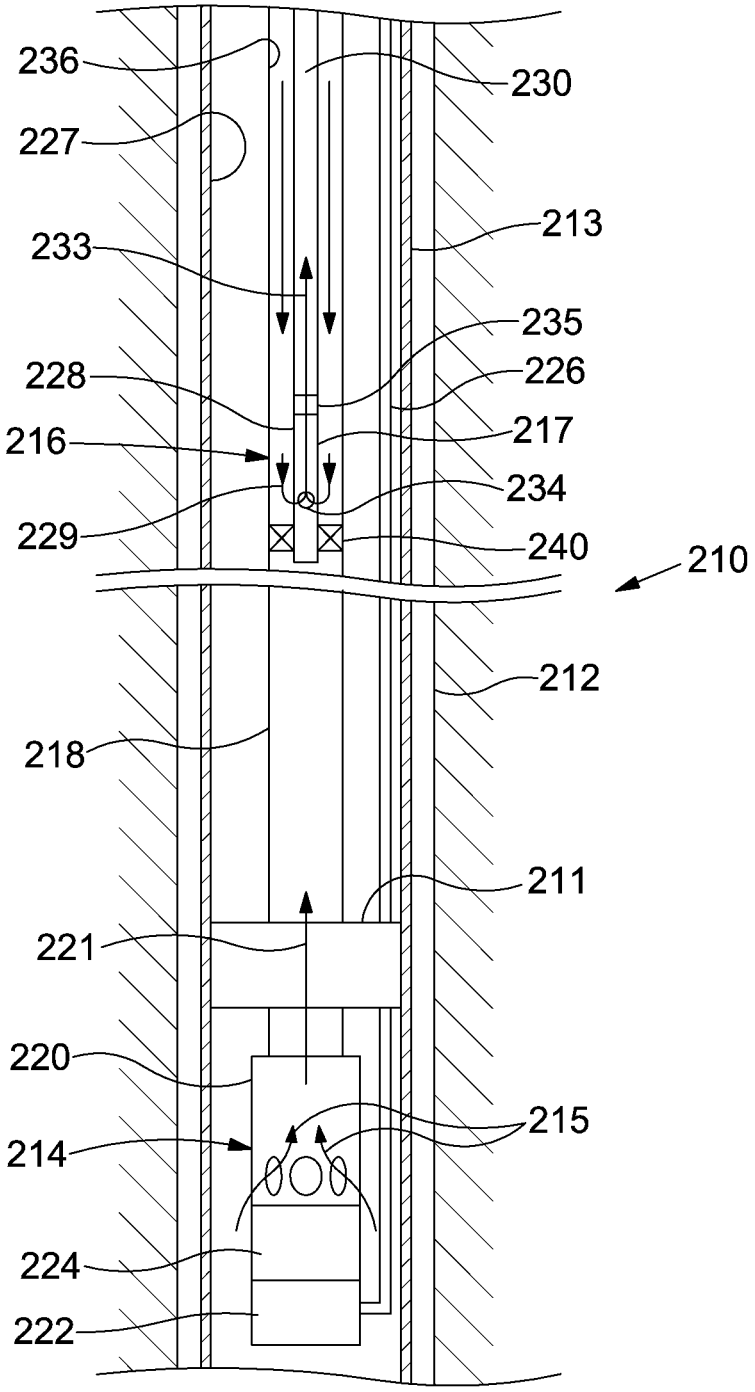
FIG. 3 is a simplified, diagrammatic representation of a production string deployed within a vertical wellbore comprising an alternative downhole artificial lift arrangement.

Turning now to FIG. 3, another embodiment of a downhole artificial gas lift system 210 is shown. The embodiment of FIG. 3 has many features in common with the embodiment of FIG. 1. Therefore, for simplicity similar or identical features are indicated with the same numerals used in FIG. 1 augmented by 200.

Accordingly, the downhole artificial lift system 210 comprises a pump arrangement generally designated with numeral 214. The pump arrangement 214 is mounted to a production string 218 deployed within casing 213. The pump arrangement 214 may be mounted to the production string using any suitable connector. The pump arrangement 214 is operatively connected to a surface power source (not shown) with a power cable 226. The power cable 226 is deployed through wellbore annulus 227 formed between the production string 218 and the casing 213 and is fed sealingly through a production packer 211.

The pump arrangement 214 comprises a pump unit 220, an electrical motor unit 222 that drives the pump unit 220, and a protector 224 to prevent fluids from entering the electrical motor unit 222. The electrical motor unit 222 may comprise any suitable motor, such as a three phase induction motor. The pump unit 220 may comprise a multi-stage centrifugal pump having multiple pump stages. In operation, fluid indicated by arrows 215 may enter the pump unit 220 via one or more suction ports 219 and may be pumped towards the surface through the production tubing as indicated by arrow 221.

The downhole artificial lift system 210 further comprises an ILLS generally designated with numeral 216 comprising a gas lift arrangement generally designated with numeral 217. The gas lift arrangement 217 is positioned within the same production string 218 at a location above the pump arrangement 214 i.e. closer to the surface or an entry point of the wellbore than the pump arrangement 214. The gas lift arrangement 217 comprises a housing 228 mounted to a coiled tubing 230 via a suitable connector 235. However, any other suitable means and/or connectors may be used to make the connection between the housing 228 of the gas lift arrangement 217 and the coiled tubing 230 such as for example a welded connection.

The housing 228 is mounted generally at an end of the coiled tubing 230. Such configuration may allow the outside diameter of the housing 228 to vary while at the same time allowing ready connection with a coiled tubing 230 via a suitably sized connector.

However, any other suitable mounting configuration may be used. For example, the housing 228 may be sized so that it may be inserted within an end section of the coiled tubing; or the housing 228 may be mounted outside the coiled tubing 230.

The housing 228 defines a central internal passage in fluid communication with the interior of the coiled tubing 230. The housing 228 further comprises a laterally extending port 234 fluidly connecting the central internal passage of the housing 228 with an annulus 236 formed between the production string 218 and the coiled tubing 230. A gas lift valve (not shown), is disposed within the housing 228 for controlling fluid flow between the annulus 236 and the interior of the coiled tubing 230. The valve may be any suitable valve and may comprise a valve element typically in a closed configuration to block fluid communication between the annulus 236 and the internal passage of the housing 228.

Unlike the embodiment of FIG. 1, the gas lift arrangement 217 allows delivered gas through the annulus 236 to enter the housing 228 as indicated by arrows 229 and then through the interior of the coiled tubing 230 return to the surface together with the produced fluid as indicated with arrows 233. Packer 240 isolates the annulus 236 from an area generally below port 234 of the gas lift arrangement 217. Hence, according to this embodiment, produced fluid reaching the gas lift arrangement 217 may enter the central passage of the housing 228 and from there the interior of the coiled tubing 230 to be lifted to the surface while being aided by the delivered gas.

Figure 4:
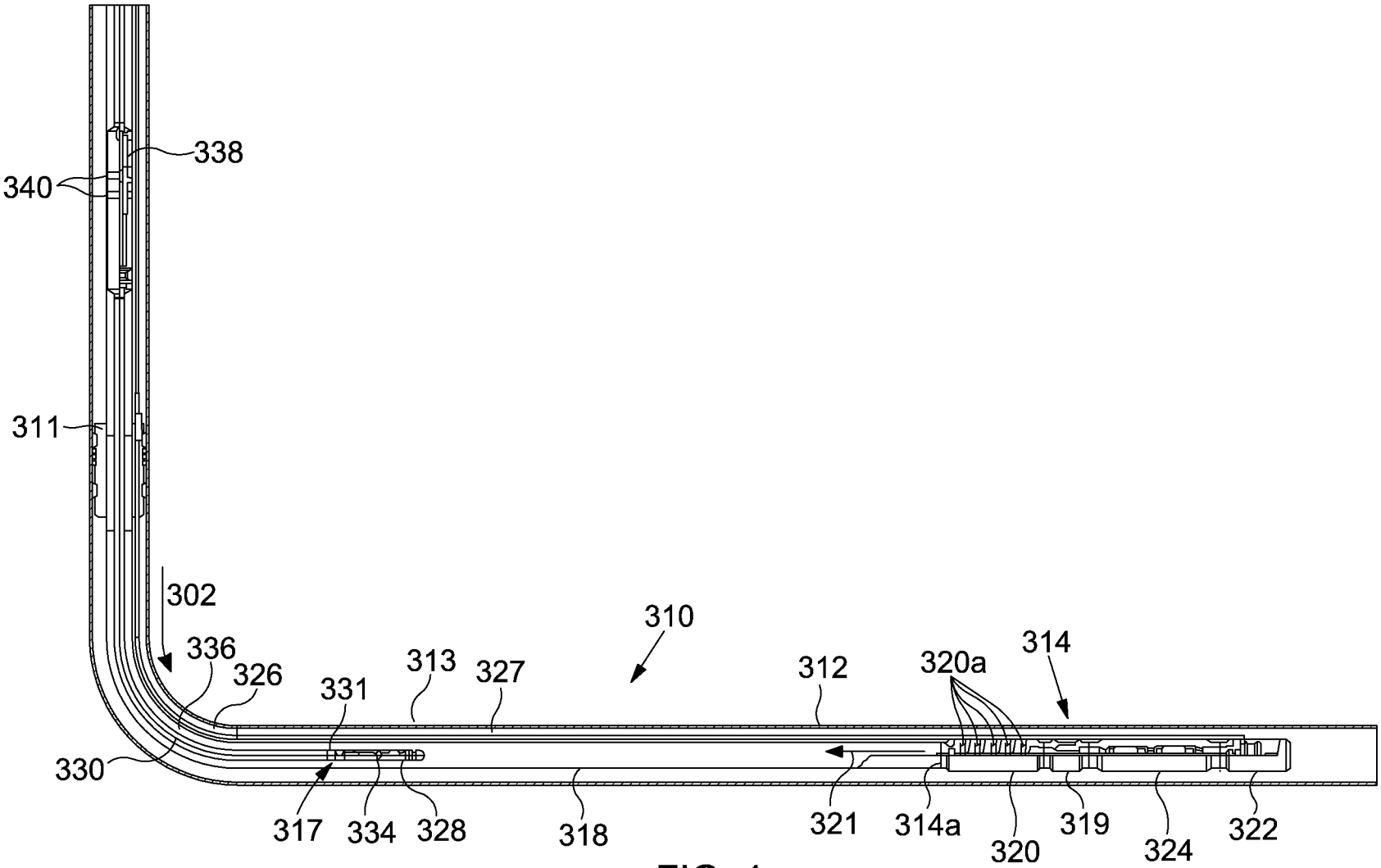
FIG. 4 is a simplified, diagrammatic representation of a production string deployed within a horizontal wellbore comprising a downhole artificial lift arrangement.

Referring now to FIG. 4, there is shown a downhole artificial lift system generally designated with numeral 310, according to yet another embodiment of the invention. The embodiment of FIG. 4 has many features in common with the embodiment of FIG. 1 and for simplicity similar or identical features are described with the same numerals augmented by 300.

The downhole artificial lift system 310 is shown deployed within a horizontal wellbore 312 having a casing 313 lining the wellbore wall. The downhole direction is generally indicated by arrow 302.

The downhole artificial lift system 310 comprises a pump arrangement generally designated with numeral 314 and a gas lift arrangement generally designated with numeral 317 both arrangements being disposed within production string 318. The pump arrangement 314 is operatively connected to a surface power source (not shown) with a power cable 326 that is deployed through wellbore annulus 327 and a packer 311. Packer 311 may be any suitable packer such as a production packer used to seal the area between the outside of the production string 318 and the inside of the casing 313.

The pump arrangement 314 comprises a pump 320, an electrical motor 322 and a protector 324 and is mounted to the production string 318 via a suitable connector at one end 314 a thereof. The electrical motor 322 may be any suitable motor, such as, for example, a three phase induction motor. The pump 320 is a multi-stage centrifugal pump having 5 stages 320*a*. In operation, fluid enters the pump 320 via one or more ports 319 and is pumped towards the surface through the production tubing 318 as indicated by arrow 321.

The gas lift arrangement 317 as shown in FIG. 4 forms part of an ILLS. The gas lift arrangement 317 is positioned within the same production string 318 at a location above the pump arrangement 314 i.e. closer to the surface or an entry point of the wellbore than the pump arrangement 314. The gas lift arrangement 317 comprises a housing 328 mounted to a coiled tubing 330 via a suitable coiled tubing connector 331. However, any other suitable means and/or connectors may be used to make the connection between the housing 328 of the gas lift arrangement 317 and the coiled tubing 330 such as for example a welded connection.

The housing 328 is mounted at an end 314 of the coiled tubing 330. Such configuration may allow the outside diameter of the housing 328 to vary while at the same time allowing ready connection with a coiled tubing 30 via a suitably sized connector 331. However, any other suitable mounting configuration may be used. For example, the housing 328 may be sized so that it may be inserted within an end section of the coiled tubing 330; or the housing 328 may be mounted outside the coiled tubing 30.

In the embodiment of FIG. 4 only one gas lift arrangement 317 is provided. However, it should be understood and that one or more gas lift arrangements 317 may be mounted in a series configuration to the same coiled tubing 330. Such configuration may permit better dispersion of the delivered gas into the fluid being lifted through the production tubing to the surface.

The housing 328 defines a central passage (not shown) aligned and in fluid communication with the interior bore of the coiled tubing 330. The housing 328 further comprises a laterally extending port 334 fluidly connecting the central internal passage of the housing 328 with an annulus 336 formed between the production string 318 and the coiled tubing 330. Annulus 336 is also referred to as the coiled tubing annulus. A gas lift valve (not shown) for example an injection valve, is disposed within the housing 328 for controlling fluid flow between the interior of the coiled tubing 330 and the annulus 336. The valve may be any suitable valve and may comprise a valve element typically in a closed configuration blocking fluid communication between the central passage of the housing 328 and the annulus 336. For example, the valve element may be urged against a mating valve seat, using any suitable means, such as springs, to block fluid communication between the central internal passageway of the housing 328 and the annulus 336. When the gas lift valve is activated, the valve element may be moved back from its seat to allow fluid delivered from the surface through the coiled tubing 330 to pass through the internal passage of the housing 328, and exit through the port 334 into the annulus 336.

Activation of the gas lift valve may be achieved via any suitable mechanism. For example, a typical gas injection valve may be activated by delivering gas into the coiled tubing at a sufficient high pressure to overcome the bias force exerted on the valve element.

According to one embodiment, the gas lift valve may employ gas charge bellows for urging the valve element in a closed position blocking flow through the central passageway of the gas lift valve, when the gas lift valve is not in use. To activate the gas lift valve, gas may be delivered through the coiled tubing 330 into one or more activation passageways positioned within the housing of the of the gas lift valve. Fluid flow through one or more passageways may be controlled by one or more check valves so that when the one or more check valves open delivered fluid through one or more activation passageways counteracts against the gas bellows to move the valve element to an open position. Once the gas lift valve is activated, gas flowing through the coiled tubing 330 is delivered into annulus 336 and lifts the production fluids through annulus to the surface.

The outside diameter of the housing 328 of the gas lift arrangement 317 is substantially the same as the outside diameter of the coiled tubing 330. Such configuration may facilitate deployment of the gas lift arrangement 317 within the production string 318. It may also, facilitate spooling the gas lift arrangement 317 together with the coiled tubing 330 using conventional coiled tubing spools. It should be understood, however, that the outside diameter of the gas lift arrangement may vary and may be the same, larger, or smaller than the outside diameter of the coiled tubing.

It has been observed that positioning the gas lift arrangement and the pump arrangement within the same production string 318 as shown on FIG. 4 results in substantial reduction of the energy and/or voltage requirements for the pump arrangement. It should be understood that the relative positioning of the gas lift arrangement 317 and the pump arrangement 314 may vary depending on the system requirements.

Further, in the embodiment of FIG. 4 the wellbore annulus 327 is not exposed to the high pressure lift gas as this is confined to the production string 318. Accordingly, the cable 326 for the pump arrangement 314 will be protected from the effects of high pressure gas.

In operation, gas is delivered from the surface through the coiled tubing 330, enters a central passage of the housing 328, and through lateral port 334 exits into annulus 336 to mix with the produced fluid to reduce its density and lift the fluid towards the surface.

The downhole artificial lift system 310 may comprise other components. For example, the system may comprise a safety valve 338 positioned within the production string 318 at a location above the gas lift arrangement 317 for providing a safety fluid barrier. The safety valve 338 may be a dual flow safety valve as the one shown in FIG. 4, and may comprise two flow paths, a central bore flow path fluidly connected at both ends thereof to the interior of the tubing and one or more annular bores fluidly connected to the fluid flow in the annulus 336 formed between the coiled tubing 330 and the production string 318. The central bore fluid path may be used to inject gas into the production string 318 via the coiled tubing 330 and the gas lift arrangement 317. The annular bores may be used for the produced fluids to flow to the surface together with the returning delivered gas. One or more seals 340 may be used to seal the area between the outside wall of the dual flow safety valve 338 and the production string 318. A valve element such as a flapper valve may be used to control the gas flow though the central bore of the safety valve 338.

Although the invention has been described in terms of the embodiments of FIGS. 1, 3 and 4, it should be understood that many other variations of the invention are possible without departing from the scope of the invention. For example, albeit the downhole artificial lift system is shown in FIGS. 1, 2 and 4 deployed within a cased wellbore, it should be understood that the downhole artificial lift system 10 may also be used with openhole wellbores.

Also, although in the embodiments of FIGS. 1, 2 and 4, only one gas lift arrangement is shown, it should be understood that the invention is not limited in this way and that one or more gas lift arrangements may be used. For example, referring to the embodiment of FIG. 1, one or more gas lift arrangements 17 may be used mounted in a series configuration to the same coiled tubing 30.

The invention claimed is:

1. A downhole artificial lift system, comprising:

a production string locatable within a wellbore for communicating a production fluid from a downhole location towards surface;

a pump arrangement in communication with the production string for pumping the production fluid along the production string towards surface; and a gas lift arrangement mounted to a gas lift tubing string deployed within the production string for delivering a lift gas into the production string, wherein a tubing annulus is defined between the gas lift tubing string and the production string, wherein the gas lift arrangement is adapted to deliver the lift gas through the tubing annulus and then through one or more ports of the gas lift arrangement into the interior of the gas lift tubing string, wherein the lift gas delivered into the gas lift tubing string is returned to a surface location, mixed with production fluid, via the gas lift tubing string; and wherein the gas lift arrangement comprises one or more packers for isolating the tubing annulus at a point below the one or more points of the gas lift arrangement.

2. The downhole artificial lift system according to claim 1, wherein the pump arrangement and gas lift arrangement are positioned in a series configuration.

3. The downhole artificial lift system according to claim 1, wherein the gas lift arrangement is positioned at a location above the pump arrangement.

4. The downhole artificial lift system according to claim 1, further comprising a cable operatively linking the pump arrangement to a power source for providing power to the pump arrangement.

5. The downhole artificial lift system according to claim 4, wherein the cable is located within a wellbore annulus formed between the production string and a wall of the wellbore.

6. The downhole artificial lift system according to claim 1, wherein the gas lift arrangement is adapted to deliver the lift gas directly into the production string without delivering the lift gas into a wellbore annulus formed between the production string and a wall of the wellbore.

7. The downhole artificial lift system according to claim 1, wherein the gas lift tubing string comprises coiled tubing string.

8. The downhole artificial lift system according to claim 1, wherein the gas lift arrangement is further adapted to deliver the lift gas through the gas lift tubing string and into the production string; and wherein the lift gas delivered into the production tubing is returned to the surface location, mixed with the production fluid, via the tubing annulus.

9. A method for lifting a fluid from a downhole location towards the surface, the method comprising:

pumping the fluid towards the surface within a production string deployed within a wellbore using a pump arrangement;

delivering a lift gas into the production string via a gas lift arrangement deployed within the same production string on a gas lift tubing string extending through the production string, wherein a tubing annulus is defined between the gas lift tubing string and the production tubing string, wherein delivering the lift gas comprises delivering the lift gas through the tubing annulus and then through one or more ports of the gas lift arrangement into the interior of the gas lift tubing string by adapting the gas lift arrangement;

isolating the tubing annulus at a point below the one or more ports of the gas lift arrangement with one or more packers; and lifting the fluid mixed with the delivered lift gas towards the surface via the gas lift tubing string.

10. The method according to claim 9, comprising modifying a rate of the lift gas delivered into the production string to reduce power and/or voltage requirements for the pump arrangement, and/or maintain the operation of the pump arrangement within an optimal operating window.

11. The method according to claim 9, comprising modifying a first rate of the lift gas delivered into the production string to maintain or enhance a second rate at which the fluid is lifted towards the surface.

12. The method according to claim 9, comprising:

providing a pump arrangement in communication within the production string; and mounting the gas lift arrangement to the gas lift tubing string and deploying the gas lift arrangement and gas lift tubing string within the production string.

13. The method according to claim 12, comprising positioning the gas lift arrangement at a location above the pump arrangement.

14. The method according to claim 12, comprising deploying a cable within a wellbore annulus formed between the production string and a wall of the wellbore, the cable for operatively linking the pump arrangement to a power source for providing power to the pump arrangement.

15. The method according to claim 12, wherein delivering the lift gas into the production string comprises delivering the lift gas directly into the production string without delivering the lift gas into a wellbore annulus formed between the production string and a wall of the wellbore.

16. The method according to claim 12, wherein delivering the lift gas into the production string comprises delivering the lift gas through the gas lift tubing string and into the production string, wherein the lift gas delivered into the production tubing is returned to a surface location, mixed with the fluid, via the tubing annulus.

17. A method for improving the performance of a downhole pump system pre-installed within a wellbore for pumping a fluid from a downhole location towards the surface via a production string, the pump system having one or more pump arrangements, the method comprising:

deploying within the production string a gas lift arrangement on a gas lift tubing string;

delivering gas through the gas lift arrangement into the production string, wherein a tubing annulus is defined between the gas lift tubing string and the production tubing string, wherein delivering the gas comprises delivering the gas through the tubing annulus and then through one or more ports of the gas lift arrangement into the interior of the gas lift tubing string by adapting the gas lift arrangement;

isolating the tubing annulus at a point below the one or more ports of the gas lift arrangement with one or more packers; and lifting fluid mixed with the delivered lift gas through the production string towards the surface via the gas lift tubing string.

* * * * *